United States Patent [19]

Biermann et al.

[11] 4,337,964

[45] Jul. 6, 1982

[54] SKI BRAKE

[75] Inventors: Peter Biermann; Ralf Storandt, both of Leonberg; Rudi Feucht, Weissach, all of Fed. Rep. of Germany

[73] Assignee: GEZE GmbH, Leonberg, Fed. Rep. of Germany

[21] Appl. No.: 184,910

[22] Filed: Sep. 8, 1980

[30] Foreign Application Priority Data

Sep. 7, 1979 [DE] Fed. Rep. of Germany ..... 2936182

[51] Int. Cl.[3] ..... A63C 7/10

[52] U.S. Cl. ..... 280/605

[58] Field of Search ..... 280/605, 604, 12 AB

[56] References Cited

U.S. PATENT DOCUMENTS

| | | | |
|---|---|---|---|
| 3,989,271 | 11/1976 | Riedel | 280/605 |
| 4,066,275 | 1/1978 | Martin | 280/605 |
| 4,163,569 | 8/1979 | Horn | 280/605 |

FOREIGN PATENT DOCUMENTS

| | | | |
|---|---|---|---|
| 2412623 | 11/1975 | Fed. Rep. of Germany | 280/605 |
| 2523012 | 12/1976 | Fed. Rep. of Germany | 280/605 |
| 2,726,023 | 3/1978 | Fed. Rep. of Germany | 280/605 |

*Primary Examiner*—David M. Mitchell

*Attorney, Agent, or Firm*—Craig and Antonelli

[57] ABSTRACT

A ski brake of the type having a pair of brake arms and a boot plate which, when depressed, holds the brake arms in an in-use skiing position and which, when released, enables the brake arms to pivot to an in-use braking position under application of spring force, the brake arms partially overlying the top surface of the ski in the in-use skiing position, is improved with respect to the manner in which the ends of the brake arms are transversely pulled-in during movement to said in-use skiing position. According to a preferred embodiment, this improvement comprises the provision of control elements for achieving the transverse pulling-in of the braking arms that comprise right-angular shoulders on a bearing plate and diverging wire sections on an actuating part of the ski brake.

11 Claims, 3 Drawing Figures

SKI BRAKE

BACKGROUND AND SUMMARY OF THE INVENTION

The present invention relates to a ski brake for preventing runaway skis when a skier's boot is released from a ski binding mounted thereon. More particularly, the present invention concerns a ski brake of the type having a pair of brake arms and a boot plate which, when depressed, holds the brake arms in an in-use skiing position and which, when released, enables the brake arms to pivot to an in-use braking position under application of spring force, the brake arms straddling the sides of the ski in its braking position, but being pulled laterally inwardly to at least partially overlie the ski in the skiing position.

Ski brakes of this type are known (German Offenlegungsschrift Nos. 24 12 623, 25 23 012, and 26 06 988) the latter corresponding to U.S. Pat. No. 4,066,275, and they are characterized in that they have a particularly simple construction, wherein the spring energy for swinging the arcuate braking member is produced by elastic deformation of a somewhat U-shaped actuating part that cooperates with the ski boot. Structurally, this is achieved in that there are planes that slant downward with reference to the longitudinal axis of the ski which are associated with the extremities of the U-shaped actuating part, immediately in the zone of their pivot shafts on the bearing plate (the said slanting planes are also called running surfaces, oblique surfaces, or control surfaces). The extremities of the actuating parts slide down these planes or surfaces upon movement of the arcuate braking members, from their braking to their non-braking (in-use skiing) positions. With the sliding down of the extremities on the slanting planes, the opening between the two extremities is of necessity diminished, whereby the U-shaped actuating part (that consists of round spring wire) receives a spring tension that is sufficient to restore the arcuate member from its non-braking position upon actuation.

From this type of production of spring force, another advantageous effect results, in that, by the reduction of the opening between the extremities, the pivot shafts undergo an axial shift with reference to the longitudinal axis of the ski and thus the opening between the brake arms connected to the pivots is likewise reduced, so that in the non-braking position of the arcuate member, the brake arms can lie at least partially on the upper side of the ski. This pulling-in effect on the brake arms is desirable in that it reduces the possibility of the brake arms hanging up on obstacles, or being grazed when the skis are travelling at an angle to the ground, as well as making it possible to maintain a closer parallel ski position.

A ski brake of the type in question for the production of a pulling-in effect is known (German Offenlegungsschrift No. 27 26 023) in which the spring force is produced by a separate spring, but the pulling-in of the brake arms, as in the above-mentioned ski brakes, is effected by means of slanting planes associated with the bearing plate. In addition to the advantage of a structural optimizing of the individual functioning parts for pulling-in and for production of spring force, this ski brake has the further advantage that by the separation of these two functions there can be the most effective pulling-in of the brake arms according to any angle of pivoting of the arcuate braking member from its braking position into its non-braking position, especially just after attaining the position of closure. This advantage has the effect that the distance of the brake arms from the lateral surfaces of the ski can be kept relatively small.

However, all prior art forms noted above present the same drawbacks with respect to the pulling-in of the brake arms via slanting planes.

The desired reduction of the opening at the end of the brake arms is, for example, 14 mm (i.e., 7 mm to each side). The pulling-in path and the distance from the slanting planes to the bearing plate, in the longitudinal direction of the ski, to the pivot shafts determine an angle of inclination between the above-noted slanting planes and a perpendicular to the ski. In known embodiments, the angle of inclination is greater than or equal to 20°. This angle directly influences the normal force that acts in a way that affects tolerances, perpendicularly to the slanting plane at the point of contact between the extremity of the actuating part and the said slanting plane, and results from the force necessary for guiding the two extremities together. The normal force again, together with the friction factor, determines the friction force whose line of action coincides with the slanting plane. Both the normal and friction forces have a vertically directed force component that has a negative influence on the likewise vertically directed actuation force exerted by the boot of a skier in the sense that a greater actuating force is required than an opening force. Additionally, the normal force and the friction force resulting from it cause heavy wear because of increased surface pressure at the sliding planes, and from this in turn there are greater friction forces.

To avoid these drawbacks, ski brakes were developed in which the pulling-in of the brake arms occurs via so-called extension devices (e.g., U.S. Pat. No. 4,062,553). However, ski brakes of this type no longer are attractively simple.

The present invention is thus concerned with the problem of producing a ski brake with arms that can be pulled-in, that can retain a simple construction that is not readily subject to damage, which requires no supplementary structures for the function of pulling-in the brake arms, and that moreover reduces the above-mentioned drawbacks by lessening the associated forces so as to lessen surface pressure and wear, and lessen insensitivity to tolerances, and that in the position of closure, causes no extra vertical forces beyond that of the spring force.

This problem is solved in accordance with a preferred embodiment of the present invention by the provision of a control element for achievinng the transverse pulling-in of the braking arms that comprises right-angular shoulders on the bearing plate and diverging wire sections on an actuating part of the ski brake.

In order to ensure the least possible distance between the brake arms and the lateral surfaces of the skis, according to another characteristic of the present invention, the wire sections in the shoulders are so arranged and constructed that advantageously they only come into engagement when there is still a pulling-in pivot angle of about 15° to 30°. This has a positive effect, particularly on the magnitude of the pulling-in path and therefore also in turn on the stresses that occur. In order not to have excessively great supplementary vertical forces resulting from the normal force that is determined by the pulling-in force, the angle by which the sections diverge from the longitudinal axis of the ski brake amounts to 5° to 15°, and preferably, 10°. For a narrow construction of the ski brake also in the region of the actuating part, it is also advantageous if the diverging sections turn at a point into converging sections and then after a certain length to further longitudinally extending sections, whereby the position of the turning point determines the pulling-in path at the end of the brake arms. If a bend should not be possible for reasons of space requirements, for example, according to another characteristic of the invention, the length of the wire sections or of the shoulder edge, will determine the pulling-in path.

It is particularly advantageous if the height of the shoulder perpendicular to the ski baseplate is greater than or equal to the radius of the wire sections. This feature enables, in the in-use skiing position of the brake, the normal force to act on the wire sections that are perpendicular to the ski in a perpendicular direction and thereby, except for the acting spring force, no supplementary vertical forces will be produced.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
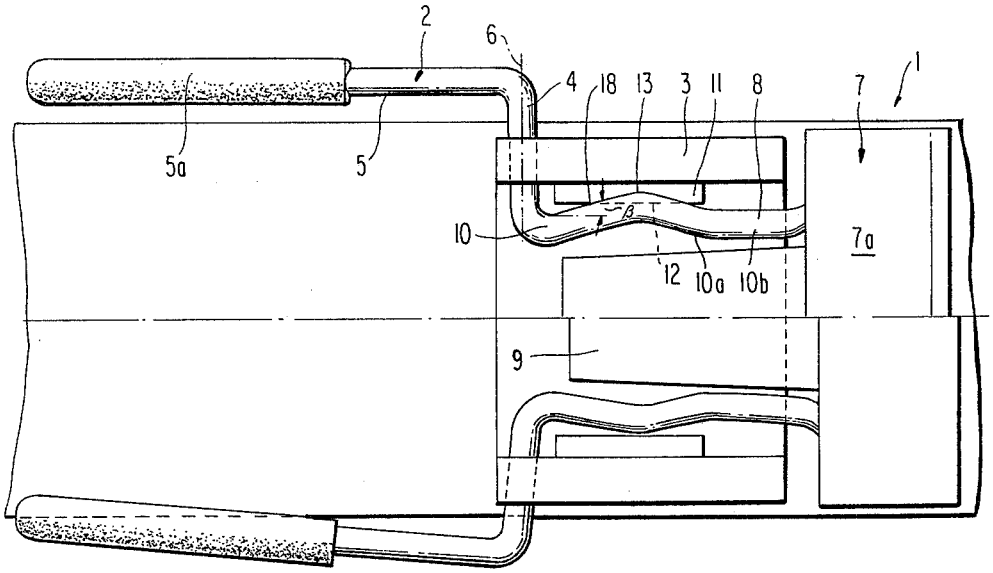
FIG. 1 shows the ski brake according to the present invention in top view, the portion above the central longitudinal axis being in a position partially displaced towards the in-use skiing position, and below the central longitudinal axis, in its in-use skiing position.
Figure 2:
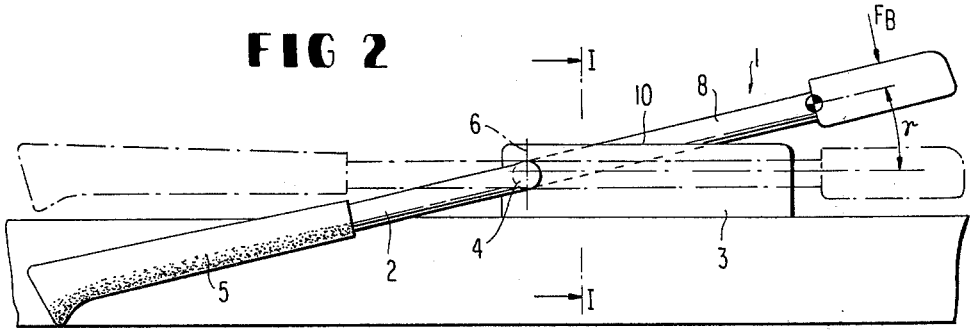
FIG. 2 shows the ski brake according to FIG. 1 in a lateral view, the dot dashed line representing the portion of FIG. 1 below the central longitudinal axis.
Figure 3:
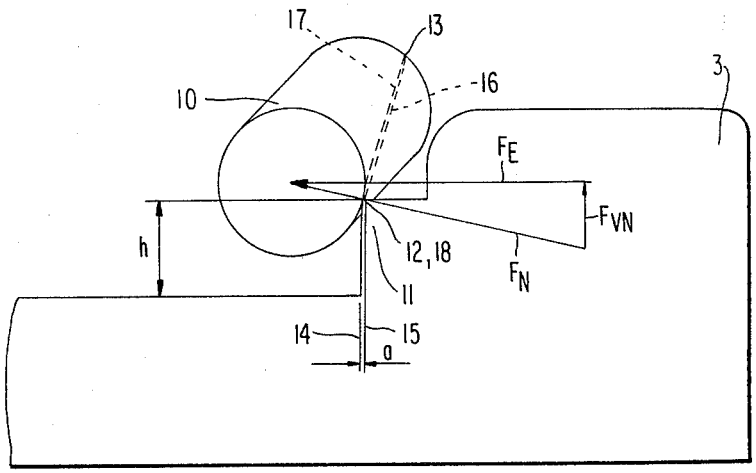
FIG. 3 is a partial section of the brake taken alone line I—I of FIG. 2 on an enlarged scale.

A ski brake designated generally by the reference numeral 1 is shown disposed on a ski in FIGS. 1 and 2. The ski brake 1 is shown in the top half of FIG. 1 and in solid lines in FIG. 2 in the position where, with further movement of the boot plate *7a* downward, the brake arms will be lifted and pulled laterally into their non-braking (in-use) skiing position. The structure of the ski brake itself is as follows. Ski brake 1 comprises an arcuate brake member 2 made of round wire, which is borne in a bearing plate 3 that is fixed relative to the ski. The arcuate braking member 2 is rotatable about a transverse ski axis 6 by means of pivot shafts 4. The laterally outer ends of the pivot shafts 4 bend and merge into brake arms 5 that run on the longitudinal lateral sides of the ski; said arms may have extruded plastic brake collars *5a*. The inner ends of the pivot shafts 4 bend and merge into a somewhat U-shaped actuating part 7 with extremities 8 that run in the longitudinal direction of the ski and ski brake apparatus. The braking force is produced by a spring element 9 disposed between the extremities 8 on the base of actuating part 7 to which is attached step strip *7a* for controlling of the braking member 2 in responsse to it being engaged or disengaged by a skier's boot. Spring element 9 acts upon bearing plate 3 so as to bias strip *7a* upwardly and braking arms 5 downwardly to a braking position. Spring element 9 may be made, for example, as a packet of leaf springs that movably bear on the upper side of the bearing plate behind the transverse axis of the ski in the longitudinal direction of the arms 5 and ski.

Starting from the region of the pivot shafts 4, extremities 8 are made as divergent sections 10 lying in the plane of step strip *7a*, the said wire sections 10 advantageously turn at a point 13 into converging sections 10*a*, then, after a certain length, to further sections 10*b* which run in the longitudinal direction of the ski brake. Bearing plate 3 has an essentially U-shaped transverse cross-section, whereby in the in-use skiing position, the actuating part 7 comes to lie between its upright side pieces. The inner surfaces of the upright pieces have right-angular shoulders 11 of a specific length. The shoulders 11 have surfaces which extend parallelly and perpendicularly with reference to the ski and bottom wall of the bearing plate mounted thereon. As can be seen, in the longitudinal direction of the ski and ski brake, shoulders 11 are at such a distance from transverse axis 6 that the divergent sections 10 will come into contact with edges 12 of the shoulders 11, at the latest, when the brake arms, during shifting to the non-braking (in-use skiing) position are at about the height of the running surface of a ski of standard ski thickness. The distance is thus a function of the dimensions of the ski brake which should be selected such that the angle $\gamma$ remaining when the arms reach the running surface is not greater than 30°, and preferably 15°. The length of the shoulders 11 is such that, when the brake is in the in-use skiing position, they extend at least to the turning point 13 of divergent sections 10, hence over the effective length thereof. Angle $\beta$ at which sections 10 diverge outwardly from the longitudinal axis of the ski and ski brake is of particular importance. This angle $\beta$ is such that a perpendicular line 14 through the contact point 18 of edges 12 on section 10 will be a short distance a from a line 15 within the same transverse plane, that is perpendicular to the horizontal diameter of section 10 at the outer surface of the wire.

The edge 12 is thus practically tangent to section 10 from the outside. This has the functionally important advantage that the normal force $F_N$ has a magnitude that almost equals the necessary pulling-in force $F_E$ and thus only a slight vertical force $F_{VN}$ opposes actuating force $F_V$ However, there is also a slight vertical force component resulting from the friction force that overlays the actuating force, since the normal force is about equal to the pulling-in force and thereforere $\mu.F_E \approx \mu.F_N$ where $\mu$ equals the friction factor. These relationships, including distance a are maintained over the whole pulling-in pivot angle $\gamma$ in such a manner that the contact point 18, between edge 12 and section 10 runs, along a generatrix 16 which always is somewhat below the tangential generatrix 17 (i.e., the generatrix of the point of intersection of the line 15 and the horizontal wire outer diameter) until the two generatrices meet at turning point 13. The pulling-in path itself is thereby determined by the horizontal distance of the initial contact point 18 from turning point 13 in the transverse direction of the ski and ski brake. It is essential that this pulling-in path (which in view of the lever relationships determines the pulling-in path at the end of the brake arms) is divided on a relatively long slide path (length of generatrix 16), which contributes in particular to tolerance sensitivity. It is further a particular advantage if the height H of shoulder 11 is made greater than or equal to the radius of the wire forming extremity 8 because then, in the in-use skiing position of the brake, turning point 13 lies on the vertical surface of the shoulder 11 so that the force $F_{VN}$ is equal to 0, and hence there is no force acting supplementarily to the spring force that could possibly have a negative effect on the ski binding via the boot.

In dependence on the dimensions of the ski brake, experiments have shown that the angle $\beta$ may have a magnitude of 5° to 15°, preferably about 10°, and a length of the slide path along generatrix 16, with a pulling-in path at the location of section 10 of about 2 to 2.5 mm may be approximately 10 to 18 mm.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Ski brake comprising an arcuate braking member made of wire borne in a bearing plate so as to be rotatable about a transverse axis by means of pivot shafts, against the force of a spring, said pivot shafts merging at an inner end into a somewhat U-shaped actuating part and at an outer end into longitudinally extending braking arms, and control elements disposed on the actuating part and the bearing plate, said control elements acting in such a manner that the brake arms, during movement toward a non-braking, in-use skiing, position, move supplementarily with reference to a central longitudinal axis of the ski brake such that in the non-braking position they are transversely pulled-in to a position that, in use, lies at least partly on the upper side of a ski, the improvement, wherein the control elements are constituted by wire sections of the actuating part that are disposed in a common plane and outwardly diverging with respect to said central longitudinal axis from a region near the pivot shafts, and by shoulders which are substantially right-angular in transverse cross section and disposed on the bearing plate, said shoulders extending at least over a longitudinal distance equal to the longitudinal extent of said wire sections and having longitudinal edges extending substantially parallel to said central longitudinal axis which said diverging wire sections contact and slide upon shortly before said in-use skiing position is achieved until said sections reach said in-use skiing position.

2. Ski brake according to claim 1, characterized in that the wire sections are shaped and arranged so as to come into engagement with the edges of the shoulders at the earliest when there is a residual pulling-in pivot angle $\gamma$ of not more than 30° defined between said common plane and a plane parallel to a planar bottom mounting surface of said bearing plate that passes through said pivot shafts.

3. Ski brake according to claim 2, wherein angle $\gamma$ equals 15°.

4. Ski brake as in claim 2, characterized in that an angle $\beta$ between the diverging wire sections and a longitudinal axis of the ski brake intersecting said sections is 5° to 15°.

5. Ski brake according to claim 4, wherein angle $\beta$ equals 10°.

6. Ski brake as in claim 3, characterized in that each of the wire sections is formed with a turning point, and at the start of said supplemental transverse pulling-in of the brake arms, the horizontal extent of the distance between the turning points in the transverse direction of the ski brake is greater than the distance between the edges of the shoulders.

7. Ski brake as in claim 6, characterized in that the location of each turning point on a respective wire section is arranged so as to determine the extent to which the brake arms are pulled-in.

8. Ski brake as in claim 3, characterized in that the length of the shoulders or their edges is selected so as to determine the pulling-in path at the end of the brake arms.

9. Ski brake as in one of claims 1 or 2 or 4, characterized in that the point of contact between each edge and each diverging wire section runs on a generatrix that lies slightly below a tangential generatrix of a point of said wire section corresponding to the intersection of a horizontal diameter line and a line tangent to said wire and perpendicular to said diameter line, except at said turning point where said generatrices intersect.

10. Ski brake as in claim 1, characterized in that the height of said shoulders perpendicular to an adjoining top surface of said bearing plate is at least equal to the radius of the wire of said diverging wire sections.

11. Ski brake according to claims 1 or 2 or 4 or 6, wherein said shoulders have internally facing vertical walls, said diverging wire sections engaging against said vertical walls in said in-use skiing position.

* * * * *